US007011238B1

(12) United States Patent
Sung

(10) Patent No.: US 7,011,238 B1
(45) Date of Patent: Mar. 14, 2006

(54) ADJUSTABLE CAULK DISPENSING GUN

(75) Inventor: Chia Hsien Sung, Taichung (TW)

(73) Assignee: Kent Bridge Enterprise Co., Ltd., Taichung (TW)

( * ) Notice: Subject to any disclaimer, the term of this patent is extended or adjusted under 35 U.S.C. 154(b) by 0 days.

(21) Appl. No.: 11/226,945

(22) Filed: Sep. 14, 2005

(51) Int. Cl.
*B67D 5/42* (2006.01)

(52) U.S. Cl. ..... 222/391

(58) Field of Classification Search ..... 222/391
See application file for complete search history.

(56) References Cited

U.S. PATENT DOCUMENTS 5,887,765 A 3/1999 Broesamle ..... 222/391

6,691,899 B1 2/2004 Sung ..... 222/391

*Primary Examiner*—Philippe Derakshani
(74) *Attorney, Agent, or Firm*—Charles E. Baxley

(57) ABSTRACT

A caulk dispensing gun for dispensing a viscous material received in a cartridge, includes a stock having a piston rod, an actuating plate having an aperture for receiving the piston rod, and a trigger pivotally secured to the stock and having an actuating pin for engaging with the actuating plate. The actuating plate may move the piston rod incrementally and forwardly relative to the stock to force the viscous material out of the cartridge. An adjusting device may adjust the inclination of the actuating plate relative to the piston rod, to adjust a frictional engagement between the actuating plate and the piston rod, particularly after the piston rod and the actuating plate have been worn out after use.

8 Claims, 5 Drawing Sheets

ADJUSTABLE CAULK DISPENSING GUN

BACKGROUND OF THE INVENTION

1. Field of the Invention

The present invention relates to a caulk dispensing gun, and more particularly to a caulk dispensing gun having an adjustable actuating plate adjustable to solidly engage with a piston rod, for effectively driving or moving the piston rod, and for increasing the working life of the caulk dispensing gun.

2. Description of the Prior Art

Various kinds of typical caulk dispensing guns have been developed and comprise a piston rod slidably received in a trigger housing, and a driving or actuating plate engaged onto the piston rod and coupled to a trigger, for being driven to move the piston rod along the trigger housing, and for forcing the piston rod to squeeze a fluid cartridge, or the like.

For example, U.S. Pat. No. 5,887,765 to Broesamle discloses one of the typical caulk dispensing guns and also comprises a driving or actuating plate engaged onto a piston rod and coupled to a trigger, for being driven to move the piston rod along a trigger housing, and to force the piston rod to squeeze a fluid cartridge, or the like in a reciprocating action.

Similarly, U.S. Pat. No. 6,691,899 to Sung also discloses one of the typical caulk dispensing guns and also comprises a driving or actuating plate tiltedly engaged onto a piston rod and coupled to a trigger, for being driven to move the piston rod incrementally and forwardly and rearwardly relative to a trigger housing, and to force the piston rod to squeeze a viscous material out of a fluid cartridge, or the like.

In the conventional caulk dispensing guns, a great frictional force may normally be generated between the driving or actuating plate and the piston rod, such that both the driving or actuating plate and the piston rod may be scrubbed or worn out after a term of usage, such that the driving or actuating plate may be become loose relative to the piston rod after the driving or actuating plate and the piston rod have been scrubbed or worn out. However, the driving or actuating plate may not be adjusted relative to the piston rod and thus may not be solidly engaged with the piston rod after the driving or actuating plate and the piston rod have been scrubbed or worn out.

The present invention has arisen to mitigate and/or obviate the afore-described disadvantages of the conventional caulk dispensing guns.

SUMMARY OF THE INVENTION

The primary objective of the present invention is to provide a caulk dispensing gun including an adjustable actuating plate adjustable relative to a piston rod, to adjustably and solidly engage with the piston after the actuating plate and the piston rod have been worn out, for allowing the actuating plate to effectively drive or move the piston rod, and for increasing the working life of the caulk dispensing gun.

In accordance with one aspect of the invention, there is provided a caulk dispensing gun for dispensing a viscous material received in a cartridge, the cartridge including a piston slidably received therein for moving the viscous material out of the cartridge, the caulk dispensing gun comprising a stock including a handle extended therefrom, and including at least one guide orifice formed therein, and including a frame for holding the cartridge therein, a piston rod slidably engaged through the guide orifice of the stock, and including a first end having a plunger provided thereon for engaging with the piston of the cartridge, an actuating plate having an aperture formed therein for receiving the piston rod, a trigger pivotally secured to the stock and having an actuating pin for engaging with the actuating plate, a spring biasing device for biasing the actuating plate to engage with the actuating pin of the trigger, to allow the actuating plate to move the piston rod forwardly relative to the stock to force the viscous material out of the cartridge, and an adjusting device for adjusting a tilting or an inclination of the actuating plate relative to the piston rod, to adjust a frictional engagement between the actuating plate and the piston rod, and to allow the actuating plate to solidly grasp the piston rod, particularly after the piston rod and the actuating plate have been worn out after use.

The adjusting device includes an adjusting member for engaging with the actuating plate and for adjusting the actuating plate relative to the stock and the piston rod, in order to adjust the inclination of the actuating plate relative to the piston rod and the stock.

A limiting device may further be provided for limiting a rearward movement of the piston rod relative to the stock. The limiting device includes an abutment extended from the stock, a release plate having a hole formed therein for loosely receiving the piston rod, the release plate is engaged with the abutment of the stock to limit the rearward movement of the piston rod relative to the stock when the release plate is moved rearwardly by the piston rod.

The adjusting member may be a bolt or screw, and may be threaded to the release plate, for example, and movable relative to the release plate, to adjust the actuating plate relative to the stock and the piston rod. A spring biasing device may further be provided for biasing the release plate to engage with the abutment of the stock.

The stock includes a groove formed therein and preferably located above the piston rod, and the adjusting device includes a pole slidably and movably received in the groove of the stock, for engaging with the actuating plate and for engaging with the adjusting member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
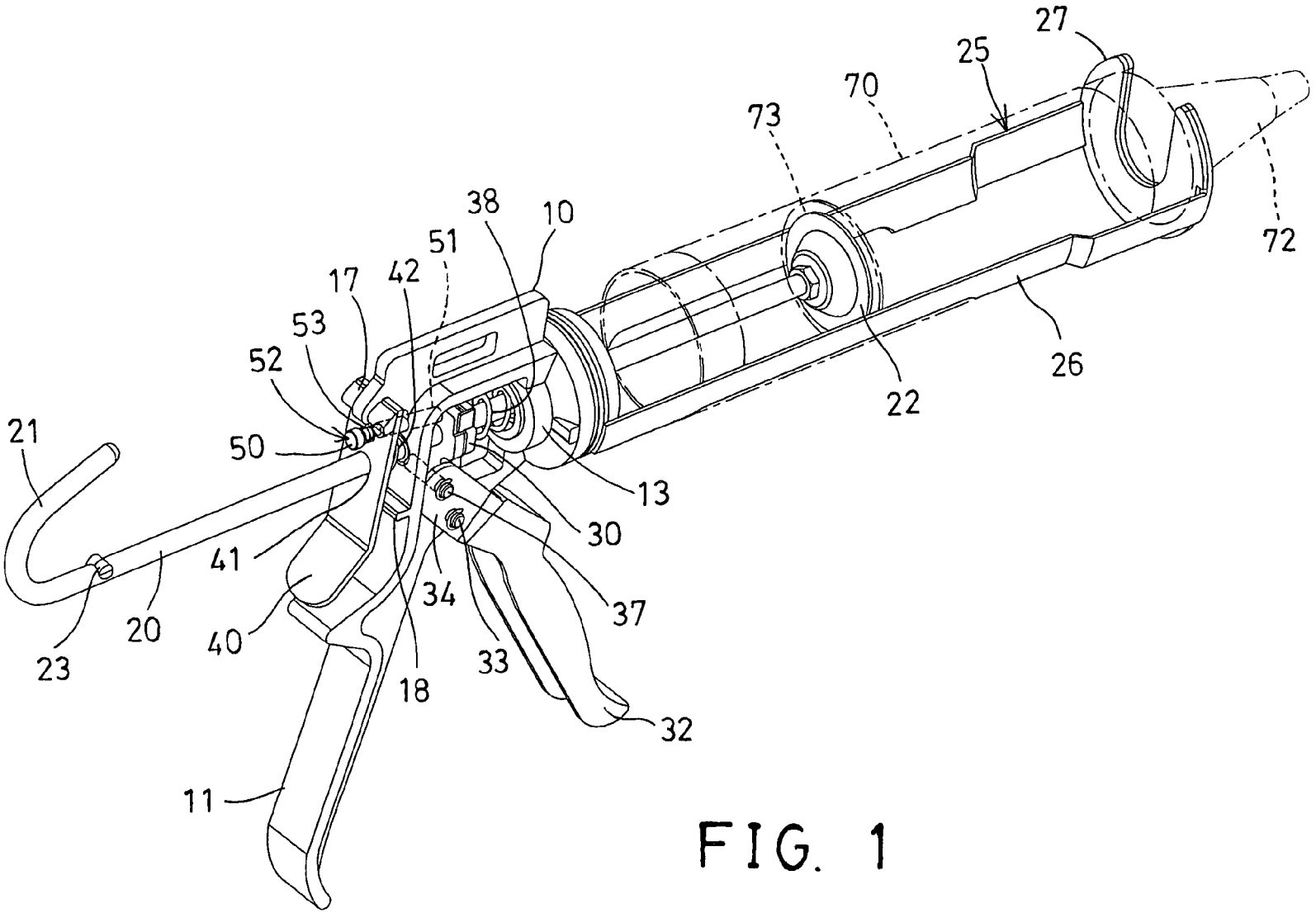
FIG. 1 is a perspective view of a caulk dispensing gun in accordance with the present invention.
Figure 2:
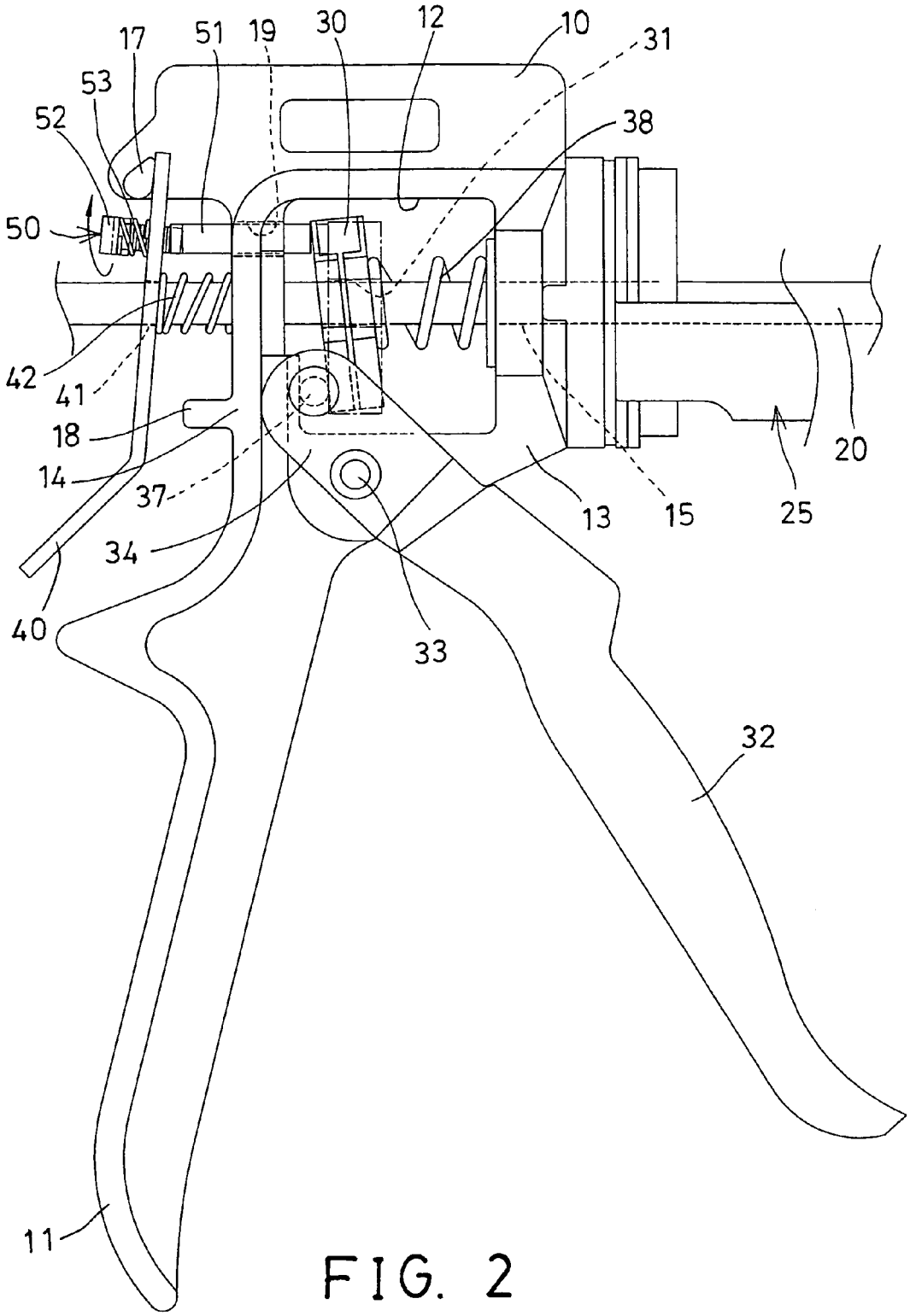
FIG. 2 is a partial side plan schematic view of the caulk dispensing gun.

Referring to the drawings, and initially to FIGS. 1 and 2, a caulk dispensing gun in accordance with the present invention comprises a trigger housing or stock 10 including a handle 11 extended downwardly and generally perpendicularly to the longitudinal axis of the stock 10, and including an opening 12 formed therein, such as formed in the middle portion thereof, and defined between a front wall 13 and a rear wall 14 each having a guide orifice 15 formed therein and communicating with the opening 12 of the stock 10, for slidably receiving a piston rod 20 therein.

The stock 10 includes an abutment 17 and an extension or a stop 18 extended rearwardly or laterally from the upper rear and the lower rear portions thereof respectively. The piston rod 20 is slidably engaged in the guide orifices 15 of the stock 10, and movable forwardly and rearwardly relative to the stock 10, and includes a curved hand grip 21 extended or provided on the rear portion thereof with which the piston rod 20 may be moved longitudinally relative to the stock 10, and includes a plunger 22 attached to the front end thereof, and includes one or more nips or projections 23 or the like extended or provided in the rear portion thereof.

A frame 25 includes two elongate beams 26 attached or secured to or extended from the front portion of the stock 10, and a ring 27 secured to the front ends of the beams 26 for receiving and holding a cartridge 70 which includes a generally cylindrical shape for containing fluid or viscous materials therein, such as the caulking mastic materials, and includes a nozzle 72 formed or provided on the front portion thereof, and includes an open rear end having a free cup-shaped piston 73 slidably received therein and slidable or movable along the cartridge 70. The plunger 22 of the piston rod 20 may be engaged with the piston 73 of the cartridge 70, for selectively moving the piston 73 along the cartridge 70, and thus for forcing the fluid or viscous materials out of the nozzle 72 of the cartridge 70.

A driving or actuating plate 30 includes an aperture 31 formed therein and having a cross section or an area slightly greater than that of the piston rod 20, for allowing the piston rod 20 to be slidably received in the aperture 31 of the actuating plate 30. The aperture 31 of the actuating plate 30 is formed or defined by a peripheral surface coincident with the corresponding peripheral surface of the piston rod 20. A trigger 32 has an upper portion rotatably or pivotally secured to the stock 10 or the handle 11 with such as a pivot axle 33, and includes an actuating upper end having one or two flanks 34 provided thereon, which are bridged by an actuating pin 37.

A compression spring member 38 is engaged around the piston rod 20, and received in the opening 12 of the stock 10, and engaged between the actuating plate 30 and the front wall 13 of the stock 10, for biasing the actuating plate 30 leftwardly or rearwardly to engage with the actuating pin 37 of the trigger 32. In operation, the actuating plate 30 may be tilted relative to the piston rod 20 by the actuating pin 37 and thus may engage and hold or grasp the piston rod 20, in order to move the piston rod 20 incrementally when the lower portion of the actuating plate 30 is forced or moved forward by the actuating pin 37 of the trigger 32.

The actuating plate 30 may be moved or biased rearwardly by the spring member 38, and thus the trigger 32 may be moved away from the handle 11 by the spring member 38 when the trigger 32 is released. However, it is to be noted that the actuating pin 37 may still be engaged with the lower portion of the actuating plate 30 and thus may still tilt the actuating plate 30 relative to the piston rod 20 when the actuating plate 30 is moved rearwardly by the spring member 38, such that the piston rod 20 may also be moved rearwardly by the actuating plate 30 when the actuating plate 30 is moved rearwardly by the spring member 38.

A release plate 40 includes a hole 41 formed therein for loosely receiving the piston rod 20, and the release plate 40 is loosely held or anchored in relation to the stock 10 by the laterally extended abutment 17 projecting from the rear portion of the stock 10. A spring member 42 is engaged on or around the piston rod 20, and engaged or biased between the rear wall 14 of the stock 10 and the release plate 40, for biasing the release plate 40 toward or to engage with the laterally extended abutment 17 of the stock 10. The spring member 42 may tilt the release plate 40 relative to the piston rod 20 to hold and anchor the piston rod 20 to the release plate 40, and to prevent the piston rod 20 from moving rearwardly relative to the release plate 40 and for allowing the piston rod 20 to move forwardly relative to the release plate 40.

Also, relatively, the release plate 40 may be moved rearwardly together with the piston rod 20 when the piston rod 20 and the actuating plate 30 are moved rearwardly by the spring member 38, until the release plate 40 is engaged with the abutment 17 of the stock 10. When the release plate 40 is engaged with the abutment 17 of the stock 10, the piston rod 20 may no longer be moved rearwardly relative to the release plate 40, and the actuating plate 30 may still be moved rearwardly relative to the piston rod 20 by the spring member 38. The above-described configuration is typical and has been disclosed in U.S. Pat. No. 6,691,899 to Sung which is taken as a reference for the present invention.

The dispensing gun in accordance with the present invention further includes an adjusting means or device 50 for engaging with the actuating plate 30, and for adjusting the tilting or the inclination of the actuating plate 30 relative to the piston rod 20 and the stock 10. For example, the stock 10 further includes a groove 19 formed therein, such as formed in the rear wall 14 thereof, and preferably located above the guide orifice 15 thereof, and the adjusting means or device 50 includes a pole 51 slidably and movably received in the groove 19 of the stock 10, for contacting or engaging with the actuating plate 30.

The adjusting means or device 50 further includes an adjusting member 52, such as a bolt or screw 52 threaded to the release plate 40, and thus adjustable or movable relative to the release plate 40 and the stock 10, and for contacting or engaging with the pole 51, and then for contacting or engaging with the actuating plate 30 via the pole 51, and thus for allowing the adjusting member 52 to engage with such as the upper portion of the actuating plate 30, and to move or to adjust the actuating plate 30 relative to the release plate 40 and the stock 10, in order to adjust the tilting or the inclination of the actuating plate 30 relative to the piston rod 20 and the stock 10 by rotating or adjusting the adjusting member 52 relative to the release plate 40 or the stock 10 (FIG. 2).

A further spring member 53 may be provided and engaged onto the adjusting member 52, and engaged or biased between the adjusting member 52 and the release plate 40, for anchoring the adjusting member 52 to the release plate 40, and for preventing the adjusting member 52 from being moved relative to the release plate 40, unless rotated or moved or adjusted relative to the release plate 40 by the users.

Figure 5:
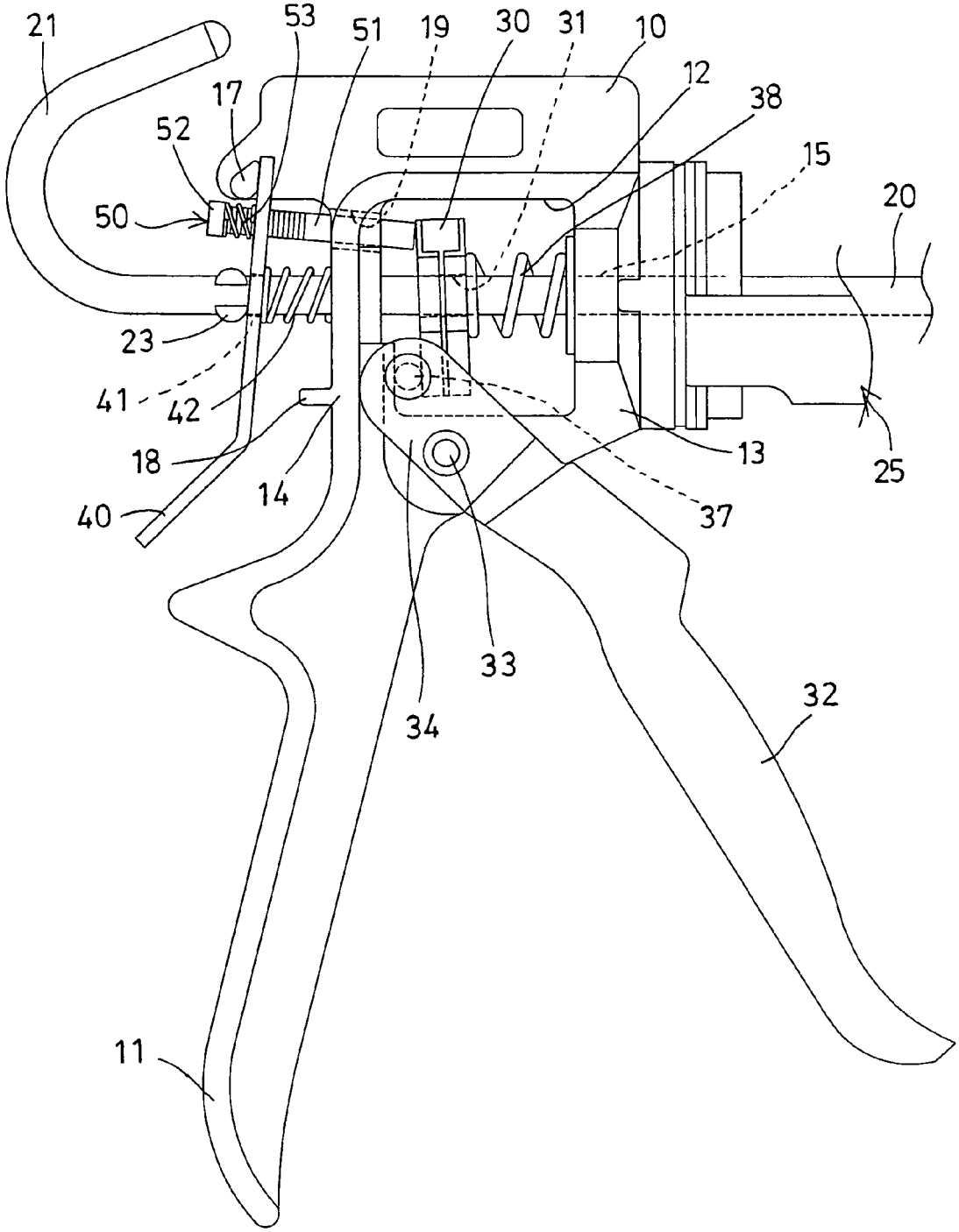
FIG. 5 is a partial side plan schematic views similar to FIGS. 2–4, illustrating the other arrangement of the caulk dispensing gun.

Alternatively, as shown in FIG. 5, the pole 51 may also be formed integral with the adjusting member 52, and thus may also be moved or adjusted by the adjusting member 52 to engage with the actuating plate 30, and to move or to adjust the tilting or the inclination of the actuating plate 30 relative to the piston rod 20 and the stock 10. Further alternatively, the pole 51 and the adjusting member 52 may also be directly attached to the stock 10, to engage with the actuating plate 30, and to move or to adjust the tilting or the inclination of the actuating plate 30 relative to the piston rod 20 and the stock 10.

Figure 3:
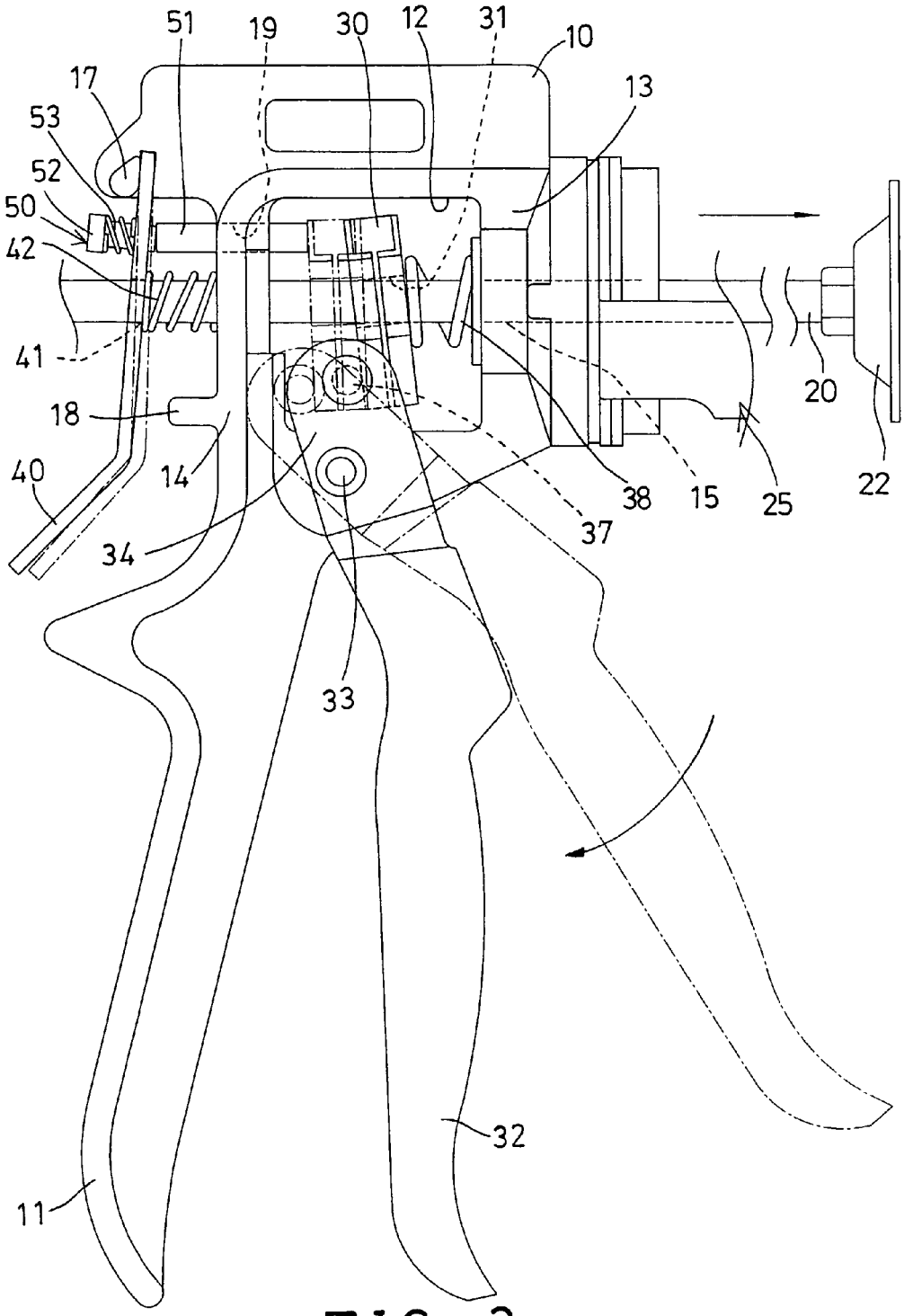
FIGS. 3 and 4 are partial side plan schematic views similar to FIG. 2, illustrating the operation of the caulk dispensing gun.

In operation, as shown in FIG. 3, the piston rod 20 may be moved forwardly and incrementally by the actuating plate 30 and the trigger 32, in order to move the plunger 22 and the piston 73 forwardly with a predetermined moving stroke, and so as to squeeze the viscous materials out through the nozzle 72 of the cartridge 70. At this moment, the release plate 40 may be slightly moved forwardly or away from the abutment 17 of the stock 10 against the spring member 42. The actuating plate 30 and the trigger 32 may thus be formed as an actuating or moving means or device for moving the piston rod 20 forwardly relative to the stock 10 and the cartridge 70.

When the trigger 32 is released, the actuating plate 30 may be moved or biased leftwardly or rearwardly by the spring member 38. At this moment, the actuating pin 37 may still be engaged with the lower portion of the actuating plate 30 and thus may still tilt the actuating plate 30 relative to the piston rod 20 such that the piston rod 20 and the release plate 40 may also be moved rearwardly by the actuating plate 30 and the spring member 38 with a small moving stroke, until the upper portion of the release plate 40 is engaged with the abutment 17 of the stock 10.

When the upper portion of the release plate 40 is engaged with the abutment 17 of the stock 10, the piston rod 20 is caused to solidly engage with the release plate 40 and may no longer be moved rearwardly relative to the release plate 40. The release plate 40 thus forms a limiting means or device for limiting the rearward movement of the piston rod 20 relative to the stock 10 and the cartridge 70. When the piston rod 20 is moved rearwardly by the actuating plate 30 and the spring member 38, the pressure of the plunger 22 against the piston 73 may thus be released, and thus releasing the viscous materials, such that the viscous material may slightly force or move the piston 73 rearwardly, and such that the viscous material will not continuously drip or flow out of the cartridge 70.

Simultaneously, when the upper portion of the release plate 40 is engaged with the abutment 17 of the stock 10 to prevent rearward motion of the piston rod 20 due to the piston rod 20 being solidly engaged to the release plate 40, the spring member 38 may still bias the actuating plate 30 rearwardly relative to the piston rod 20 and the stock 10, in which the actuating plate 30 is frictionally moved relative to the piston rod 20.

When the actuating plate 30 is moved rearwardly relative to the piston rod 20 and the stock 10 by the spring member 38 until the actuating plate 30 is engaged with the stock 10, the spring member 38 may force or bias the actuating plate 30 against the stock 10, and may erect the actuating plate 30 relative to the piston rod 20 or may cause the actuating plate 30 to be perpendicular to the piston rod 20, such that the piston rod 20 may be released relative to the actuating plate 30 by the spring member 38.

When the piston rod 20 is released relative to the actuating plate 30 by the spring member 38, the spring member 53 may bias and force or move the release plate 40 and the piston rod 20 slightly forwardly with a small return moving stroke, in order to move the plunger 22 to engage with the piston 73 again, and so as to force the air that may be drawn into the cartridge 70 out of the cartridge 70, and for allowing the viscous materials to be solidly forced outward of the cartridge 70 by the piston 73 when the piston rod 20 is moved forwardly again by the trigger 32. The spring member 53 thus forms a recovering or retrieving means or device for moving the piston rod 20 backwardly or rightwardly relative to the stock 10 and the cartridge 70.

Figure 4:
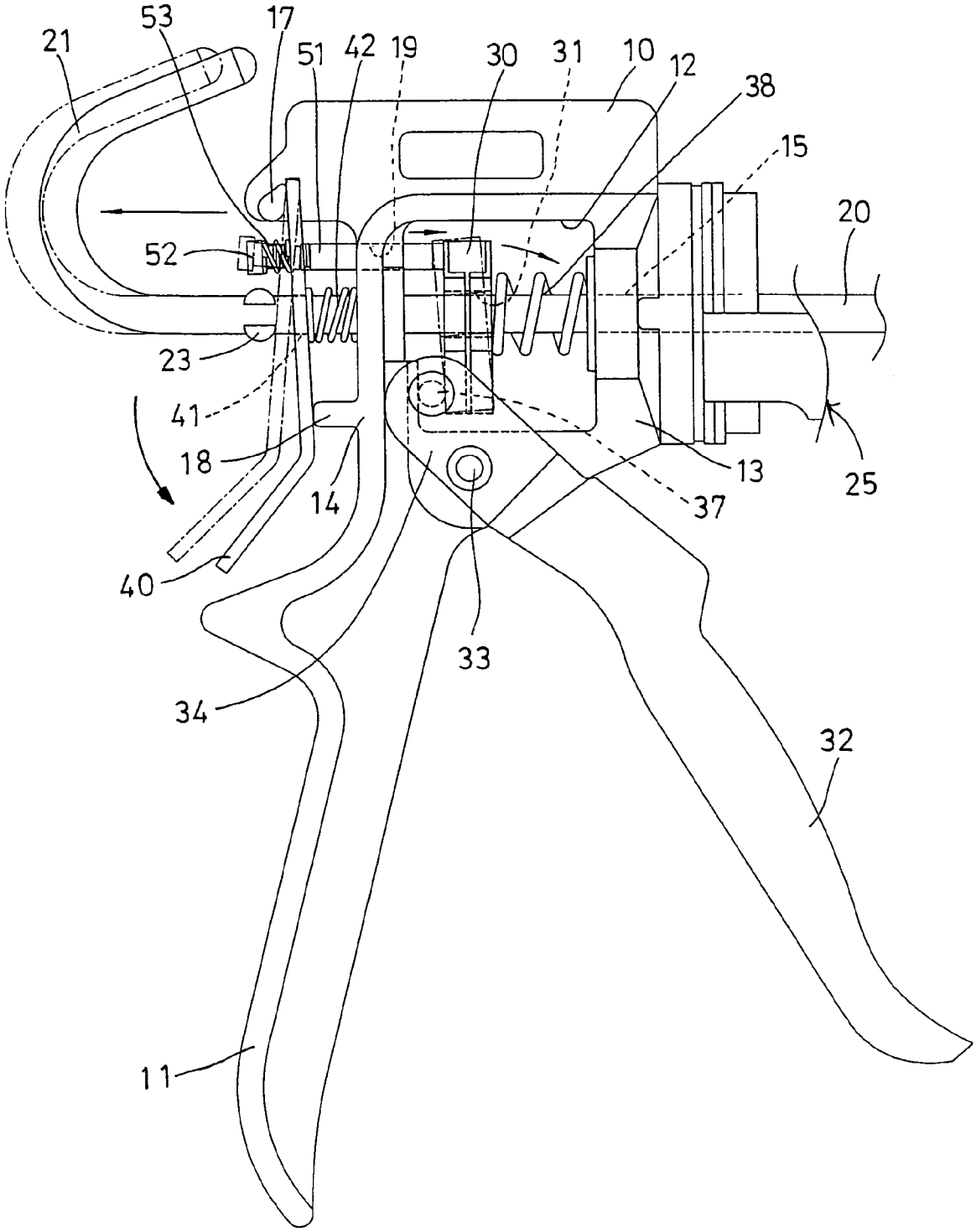

When the piston rod 20 and the plunger 22 have been moved forwardly to the forward most position relative to the stock 10, the projections 23 of the piston rod 20 may be engaged with the release plate 40, and may force the release plate 40 forwardly against the spring member 42 (FIG. 4), until the release plate 40 is engaged with the stop 18 of the stock 10. At this moment, the piston rod 20 may no longer be moved forwardly by the trigger 32. The piston rod 20 may be moved or pulled rearwardly relative to the stock 10 again when the lower portion of the release plate 40 is depressed against the spring member 42 or when the release plate 40 is erected relative to the piston rod 20 to a position perpendicular to the piston rod 20. The piston rod 20 may be released relative to the release plate 40 when the release plate 40 is perpendicular to the piston rod 20.

After use, or after the piston rod 20 has been frictionally moved forwardly relative to the stock 10 by the actuating plate 30 for a time, both the piston rod 20 and the actuating plate 30 may be scrubbed or worn out after use, such that the driving or actuating plate may be become loose relative to the piston rod 20. At this moment, the pole 51 and or the adjusting member 52 of the adjusting means or device 50 may be moved or adjusted relative to the release plate 40 and/or the stock 10, in order to move or to adjust the actuating plate 30 relative to the stock 10, and so as to adjust the tilting or the inclination of the actuating plate 30 relative to the piston rod 20 and the stock 10, and thus to allow the piston rod 20 to be solidly engaged with and moved by the actuating plate 30 again.

The conventional caulk dispensing guns have no and failed to provide an adjusting means or device 50 for engaging with the actuating plate 30, and for adjusting the tilting or the inclination of the actuating plate 30 relative to the piston rod 20 and the stock 10, and thus for adjusting the frictional engagement between the actuating plate 30 and the piston rod 20, such that the working life of the caulk dispensing gun may also be increased.

Accordingly, the caulk dispensing gun in accordance with the present invention includes an adjustable actuating plate adjustable relative to a piston rod, to adjustably and solidly engage with the piston after the actuating plate and the piston rod have been worn out, for allowing the actuating plate to effectively drive or move the piston rod, and thus for increasing the working life of the caulk dispensing gun.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A caulk dispensing gun for dispensing a viscous material received in a cartridge, the cartridge including a piston slidably received therein for moving the viscous material out of the cartridge, said caulk dispensing gun comprising:

a stock including a handle extended therefrom, and including at least one guide orifice formed therein, and including a frame for holding the cartridge therein, a piston rod slidably engaged through said at least one guide orifice of said stock, and including a first end having a plunger provided thereon for engaging with the piston of the cartridge, an actuating plate having an aperture formed therein for receiving said piston rod, a trigger pivotally secured to said stock and having an actuating pin for engaging with said actuating plate, means for biasing said actuating plate to engage with said actuating pin of said trigger, to allow said actuating plate to move said piston rod forwardly relative to said stock to force the viscous material out of the cartridge, and means for adjusting an inclination of said actuating plate relative to said piston rod, to adjust a frictional engagement between said actuating plate and said piston rod.

2. The caulk dispensing gun as claimed in claim 1, wherein said adjusting means includes an adjusting member for engaging with and for adjusting said actuating plate relative to said stock and said piston rod, in order to adjust the inclination of said actuating plate relative to said piston rod and said stock.

3. The caulk dispensing gun as claimed in claim 2 further comprising means for limiting a rearward movement of said piston rod relative to said stock.

4. The caulk dispensing gun as claimed in claim 3, wherein said limiting means includes an abutment extended from said stock, a release plate having a hole for loosely receiving said piston rod, said release plate is engaged with said abutment of said stock to limit the rearward movement of said piston rod relative to said stock when said release plate is moved rearwardly by said piston rod.

5. The caulk dispensing gun as claimed in claim 4, wherein said adjusting member is threaded to said release plate, and movable relative to said release plate, to adjust said actuating plate relative to said stock and said piston rod.

6. The according to claim 4 further comprising means for biasing said release plate to engage with said abutment of said stock.

7. The caulk dispensing gun as claimed in claim 2, wherein said stock includes a groove formed therein, and said adjusting means includes a pole slidably and movably received in said groove of said stock, for engaging with said actuating plate and for engaging with said adjusting member.

8. The dispensing gun according to claim 2, wherein said stock includes a release plate attached thereto and having a hole formed therein for loosely receiving said piston rod, said adjusting member is attached to said release plate, and movable relative to said release plate, to adjust said actuating plate relative to said stock and said piston rod.

* * * * *